US005350278A

United States Patent [19]

Burge

[11] Patent Number: 5,350,278

[45] Date of Patent: Sep. 27, 1994

[54] JOINING MEANS FOR ROTOR DISCS

[75] Inventor: Joseph C. Burge, Palm Beach Gardens, Fla.

[73] Assignee: The United States of America as represented by the Secretary of the Air Force, Washington, D.C.

[21] Appl. No.: 85,991

[22] Filed: Jun. 28, 1993

[51] Int. Cl.[5] ..... F01D 5/06
[52] U.S. Cl. ..... 416/198 A
[58] Field of Search ..... 416/198 A; 415/199.5

[56] References Cited

U.S. PATENT DOCUMENTS

| | | | |
|---|---|---|---|
| 2,309,878 | 2/1943 | Wiberg | 416/198 A |
| 3,356,340 | 12/1967 | Bobo | 416/198 A |
| 3,765,795 | 10/1973 | Koff | 416/198 A |
| 3,868,197 | 2/1975 | Hugoson | 415/199.5 |
| 4,468,148 | 8/1984 | Seymour | 416/198 A |
| 4,576,547 | 3/1986 | Weiner et al. . | |
| 4,808,073 | 2/1989 | Zaehring et al. . | |
| 4,844,694 | 7/1989 | Naudet | 416/198 A |
| 5,052,891 | 10/1991 | Burkholder | 416/198 A |
| 5,232,339 | 8/1993 | Plemmons et al. | 416/198 A |

FOREIGN PATENT DOCUMENTS

| | | | |
|---|---|---|---|
| 1191014 | 10/1959 | France | 416/198 A |
| 0011642 | 4/1970 | Japan | 416/198 A |
| 0737155 | 9/1955 | United Kingdom | 416/198 A |

*Primary Examiner*—Edward K. Look
*Assistant Examiner*—Christopher Verdier
*Attorney, Agent, or Firm*—Jacob N. Erlich; Stanton E. Collier; Thomas C. Stover

[57] ABSTRACT

In an assembly of spaced rotor discs, mounted to rotate about a common axis, one or more discs are provided that are removably joined to the other discs but so joined, away from potential fatigue points in the disc webs. Thus a pair of discs have a spacer arm extending therebetween in contact therewith. Further, each disc of such pair, has a flange that extends between the discs toward the flange of the other disc, which flanges (and thus the discs) are removably bolted together at a junction removed from the disc webs for greater disc durability and lower replacement costs thereof. The so joined flanges and spacer arm (which is held in a piloted joint under compressive pre-load) define an annular cavity around a pair of the discs and thus redundant structural support therebetween.

14 Claims, 3 Drawing Sheets

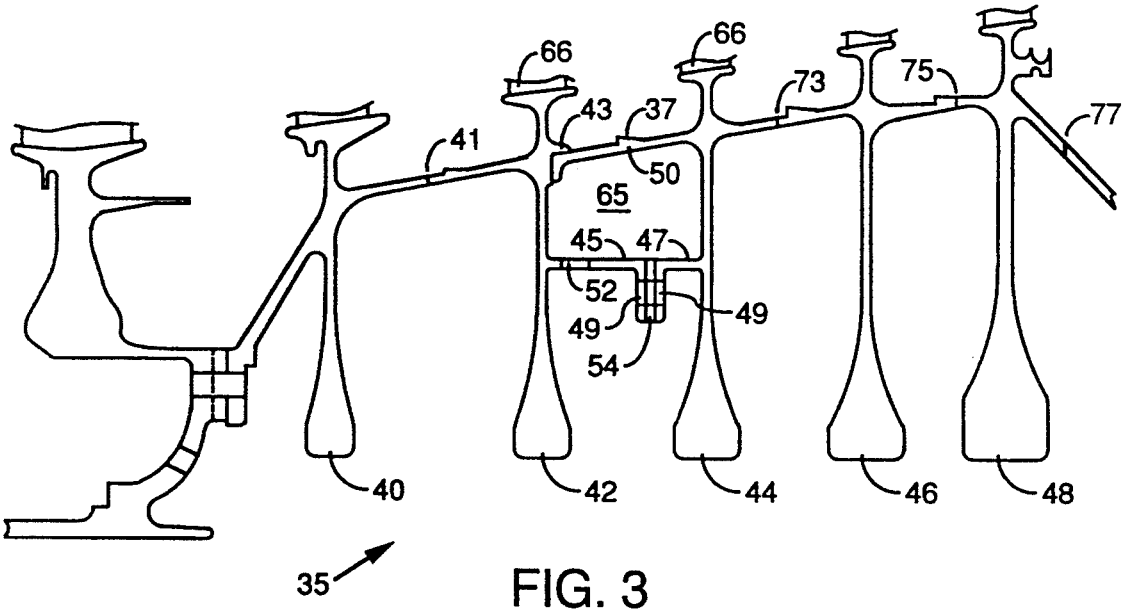
FIG. 3
FIG. 4
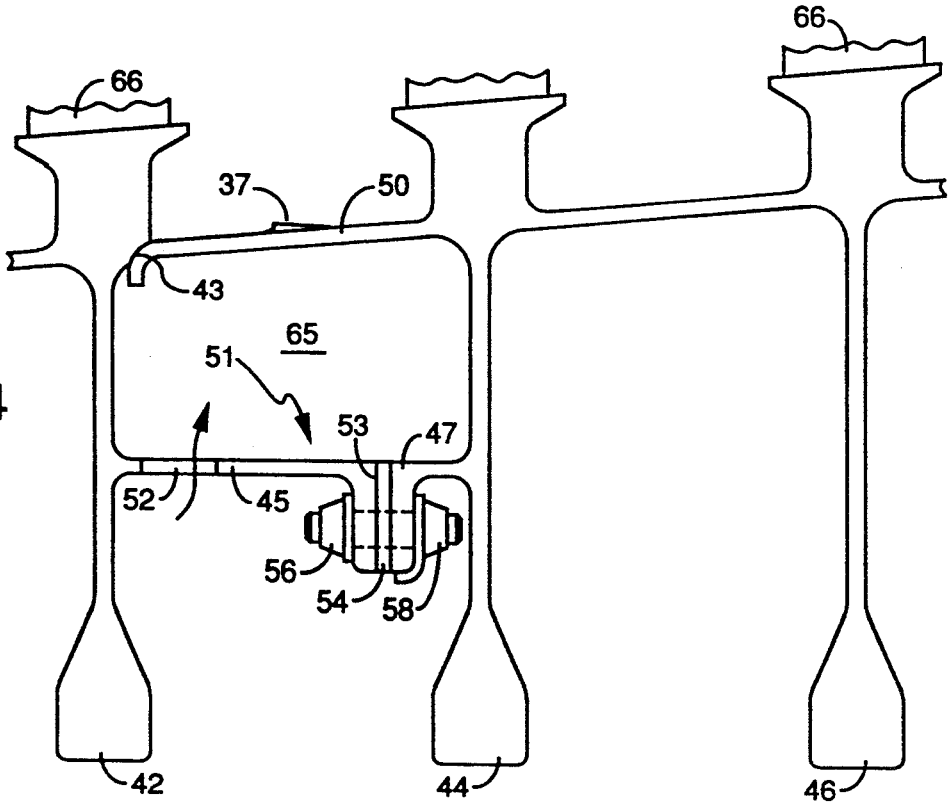
FIG. 5
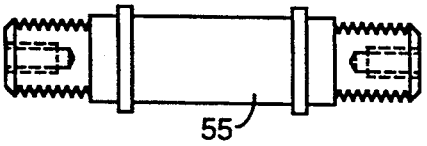

JOINING MEANS FOR ROTOR DISCS

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention

This invention relates to joining means for rotor discs particularly such joining means in a durable configuration.

2. The Prior Art

In the compressor rotor of a gas turbine engine, there is at times, a need to repair or replace components thereof, e.g. rotor discs. Rather than replace all of the discs when one is damaged, the prior art has utilized replaceable, bolted-together, disc segments, per FIGS. 1 and 2 hereof. Thus per FIG. 1, disc 10, having flange 12, and disc 14, having flange 16, are fastened together through disc 18. That is, a bolt hole is drilled through disc flange 12, disc 18 and disc flange 16 and a bolt or stud 20 passes through the respective bolt holes and fastens the above components together, as shown in FIG. 1.

Per FIG. 2, discs 22, 24, and 26 are fastened together in a similar manner by bolt 28 and discs 26, 30, and 32 are fastened together in a similar fashion by bolt 34.

But the above indicated holes (for the respective bolts) are located in disc areas of high stress during compressor rotation, as indicated in FIGS. 1 and 2.

That is, FIGS. 1 and 2 show prior art bolted-on discs of earlier gas turbine engines which have become more susceptible to disc fatigue originating at the above bolt holes, as the RPM of newer gas turbine engines has increased.

Accordingly, the above prior art disc joining means are now less acceptable for newer compressors because of low cycle fatigue life limitations at the above disc bolt holes.

In other prior art are U.S. Pat. No. 4,576,547 to Weiner et al (1986) and U.S. Pat. No. 4,808,073 to Zaehring et al (1989). However, these references disclose means for cooling compressor rotor structures and are not directed to structural means to reduce local rotor stresses for increased durability thereof.

Accordingly, there is need and market for means for joining removeable rotor discs that avoids the above prior art shortcomings. There has now been discovered a configuration for joining rotor discs wherein bolt hole stress concentrations are located away from disc high stress areas.

SUMMARY OF THE INVENTION

Broadly the present invention provides a joining means for removable rotor discs located away from potential fatigue points in said discs wherein at least a pair of spaced joinable discs are positioned to rotate about a common axis, said joining means comprising, a) a spacer arm extending between said discs in contact therewith, b) each disc having a flange spaced from the spacer arm, which flange extends between said discs toward the flange of said other disc and c) securing means to removably join said flanges and thus said discs.

Thus per the invention, individual discs can be so joined or assemblies of 2 or more discs can be so joined to each other.

BRIEF DESCRIPTION OF THE DRAWINGS

The invention will become more apparent from the following detailed specification and drawings in which;

FIG. 3 is a sectional elevation, fragmentary schematic view of a rotor blade assembly per the present invention;

FIG. 4 is an enlarged sectional elevation, fragmentary schematic view of the rotor assembly of FIG. 3;

FIG. 5 is an enlarged elevation view of a component of the rotor blade assembly of the invention shown in FIG. 4;

DESCRIPTION OF THE PREFERRED EMBODIMENTS

Figure 1:
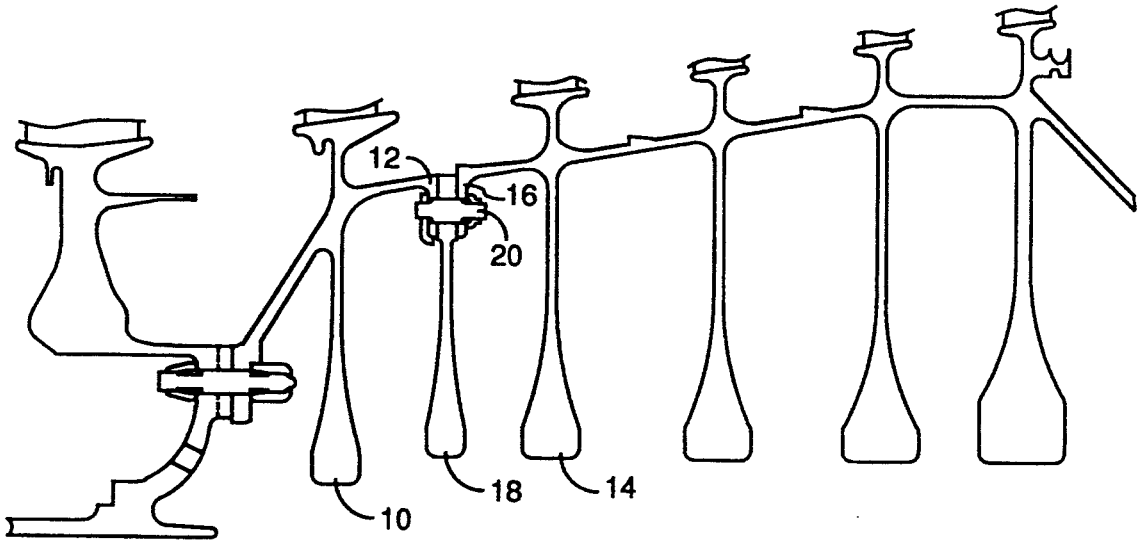
FIG. 1 ( PRIOR ART )
FIGS. 1 and 2 are sectional elevation schematic views of rotor disc assemblies of the prior art.
Figure 2:
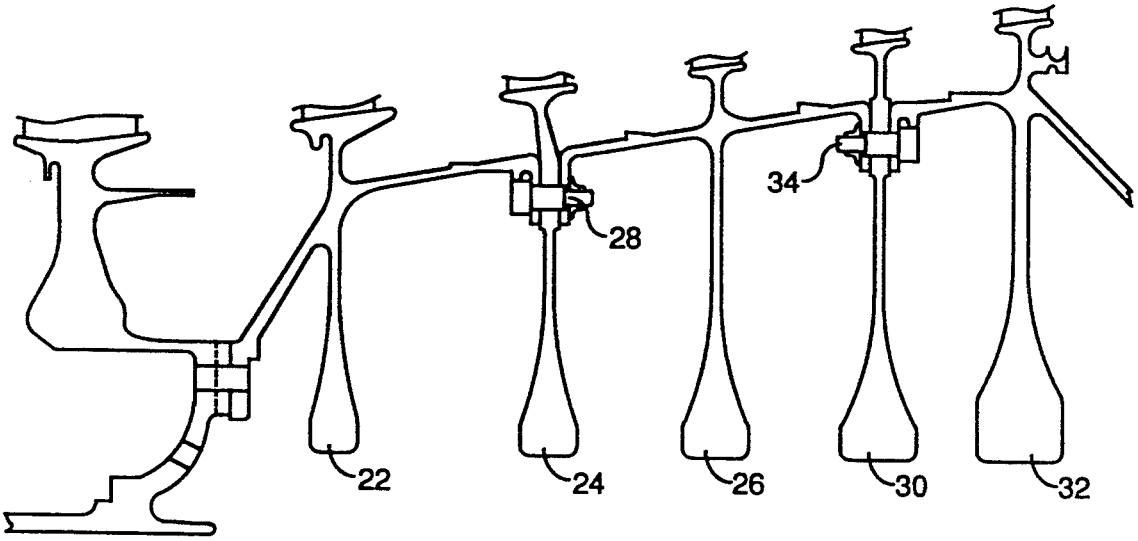
FIG. 2 ( PRIOR ART )

A rotor assembly 35 embodying the invention is shown in FIG. 3 wherein rotor discs 40 and 42 (known as second and third stages respectively) are electron beam (EB) welded together at joint 41. Also a radial and axial piloted joint 43 has been added at the rear of disc 42, i.e. at the rear of the third stage rim, per FIG. 3. Further, a cylindrical flanged extension 45 has been added to the aft web face of disc 42, again per FIG. 3.

The fourth stage disc, disc 44 has mounted on its forward web, a cylindrical flanged extension 47, which extends toward and meets cylindrical flanged extension 45, which together define a bolt or stud aperture 49 therethrough, per FIG. 3.

Disc 44 also has at an upper forward portion, an integral conical spacer arm 50, that is piloted to disc 42, at piloted joint 43, as shown in FIGS. 3 and 4. The brush seal land 37 on the conical spacer arm 50 is preferably coated with aluminum oxide material. The remainder of the O.D. of this conical spacer arm is coated, e.g. with a sprayed-on 0.010 in. thick ceramic coating.

The cylindrical flanged extension 45 has a row of uniformly spaced apertures 52, aft of the disc 42 per FIGS. 3 and 4.

The last three stages of the rotor assembly 35, discs 44, 46, and 48, are of, e.g. Gatorizeable Waspalloy (GW), with EB weld joints 73, 75 and 77, per FIG. 3.

Additional detail of the joined-together rotor discs 42 and 44 is shown in FIG. 4. Thus stud 55, shown in FIG. 5, is inserted through fastening aperture 49, shown in FIG. 3 and lock nuts 56 and 58 tightened thereon, to bolt cylindrical flanged extensions 45 and 47 and thus discs 42 and 44 and their associated discs 40, 46, and 48, as shown or indicated in FIGS. 5, 4, and 3.

Cylindrical flanged extensions 45 and 47 are bolted together at aperture 49 by stud 55 as shown in FIGS. 3, 4 and 5 to form cylinder assembly 51, as shown in FIG. 4.

The rotor assembly 35 has an active air system to limit disc bore temperatures and to decrease rotor structure transient thermal response rates or "Time Constants" (TC's). The cylinder assembly 51, between discs 42 and 44, per FIG. 4, could interfere with active air circulation between such discs. This is compensated for by the row of active air entry apertures 52, noted above and by air exit slots 54 at the juncture of cylindrical flanged extensions 45 and 47, as shown or indicated in FIGS. 4, 6 and 7.

The cylindrical flanged extensions 45 and 47 have a plurality of bolt holes 49 preferably filled by a like number of studs 55 with a like number of air exit slots 54, between the bolt holes 49, within the scope of the invention per FIGS. 4, 6, 7, and 8.

The flow of active air in the annular cavity 65 (between the cylinder assembly 51 and the conical spacer arm 50) and the ceramic coating on the O.D. (i.e. outer surface) of the conical spacer arm 50, shown in FIGS. 3 and 4, combine to minimize a transient and steady state axial differential thermal growth between the conical spacer arm 50 and the cylindrical flanged extensions 45 and 47.

The integral spacer arm 50 and the cylindrical flanged extensions 45 and 47, are preferably dimensioned such that, with no gap at the piloted joint 43, there is a small gap between the flange faces of the bolted cylindrical flanged extensions 45 and 47 (e.g. about 0.008"). When the flange bolts or studs are torqued to required levels, this results in axial compression in the conical spacer arm 50 (and at the piloted joint 43) and axial tension in the cylindrical flanged extensions 45 and 47. Thus axial preload is applied to the support members 50, 45 and 47 to unite the discs 42 and 44 per FIGS. 3 and 4. Such compression and tension prevents axial separation of the piloted joint 43 during decels but is small enough to prevent flange separation (at flange face 53) during accels, as indicated in FIG. 4. These axial load variations are caused primarily by (conical spacer arm 50 to cylindrical assembly 51) temperature variations during engine operation and the fact that such union (conical spacer arm 50—cylinder assembly 51), is a redundant structural load arrangement.

The piloted joint 43, shown in FIGS. 3 and 4, is also assembled radially tight such that, during engine operating transients, joint tightness is maintained to continue rotor dynamic stability and minimize air leakage past such piloted joint 43.

The flanged joint air exit slots 54 are milled into the face 53 of the cylindrical flanged extension 47, as shown in FIGS. 4, 6, 7 and 8. These air exit slots 54 preferably exit in scallops 60, between the bolt holes 49 of the paired flanged extensions 45 and 47, as shown or indicated in FIGS. 6, 7, and 8. The slots 54 are configured to provide a pumping effect for the active air circulation in the annular cavity 65, with minimal stress concentrations in the flanged extension 47, shown in FIGS. 3 and 4.

Figure 6:
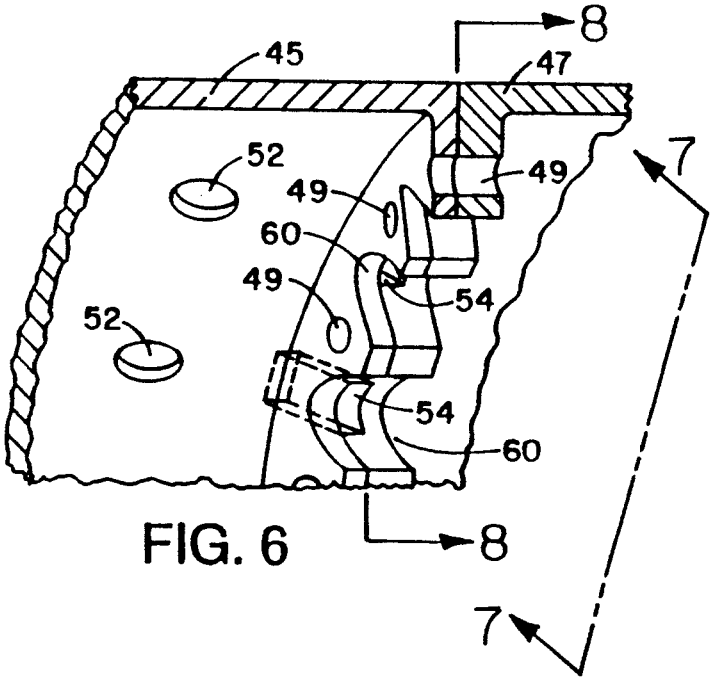
FIG. 6 is an enlarged fragmentary perspective schematic view of components of the rotor assembly of FIG. 4.
Figure 7:
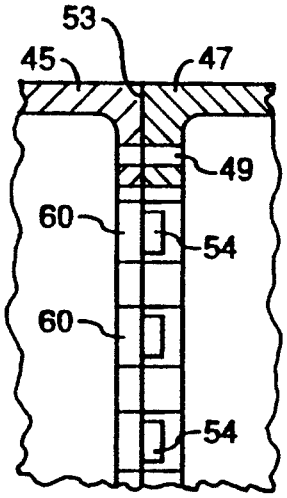
FIG. 7 is a fragmentary elevation schematic view of the component of the invention shown in FIG. 6, taken on 7—7, looking in the direction of the arrows
Figure 8:
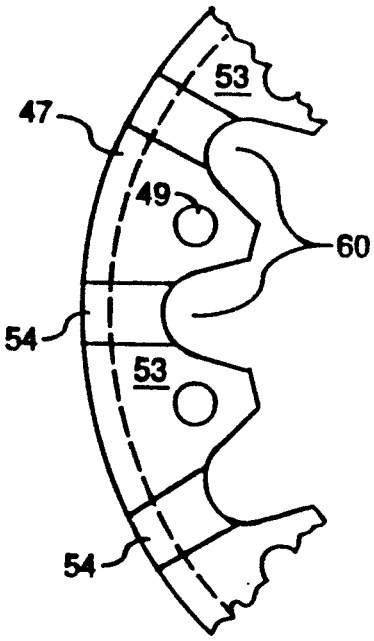
FIG. 8 is a fragmentary elevation schematic view of the component of FIG. 6, taken on lines 8—8, looking in direction of the arrows.

The paired flanged extensions 45 and 47 have edge scallops 60, per FIGS. 6 and 8, to interrupt or minimize flange bolt-hole stress concentrations. The active air entry holes 52, shown in FIGS. 3, 4 and 6, are located away from the rotor spool peak stress areas and they are relatively closely spaced to provide a shadowing effect, stress concentration reduction. Accordingly, there are no bolt-holes required through the webs of the respective discs. As for the compressor rotor blades 66, indicated in FIGS. 3 and 4, they can be integrally mounted on the discs or they can utilize circumferential or axial dovetails, as desired within the scope of the invention.

Thus the improved structure of the invention provides joining means, including bolt-holes for removable rotor discs, which are located away from potential fatigue points in the discs for increased durability and reduced replacement cost thereof.

I claim:

1. An assembly of rotor discs at least one of which is removably mounted to another of said discs, away from potential fatigue points in said discs comprising:

a) at least a pair of spaced joinable discs positioned to rotate about a common axis, b) a spacer arm extending between said discs in contact therewith, said spacer arm contacting a piloted joint in one of said discs under axial compression, c) each disc having a flange which extends between said discs toward the flange of said other disc and d) securing means to removably join said flanges under axial tension in a pre-loaded redundant support junction to also join said discs at a junction removed from said discs.

2. The assembly of claim 1 wherein the so joined flanges define a cylinder, which cylinder has vent holes therein.

3. The assembly of claim 2 wherein said spacer arm slants between said discs and relative to the so joined flanges and defines with said flanges, an annular cavity between said discs.

4. The assembly of claim 1 wherein each of said two discs are already joined to one or more other discs.

5. The assembly of claim 1 wherein said securing means are bolts or studs through bolt holes.

6. The assembly of claim 1 wherein said flanges have edges which are scalloped.

7. The assembly of claim 1 wherein said discs have rotor blades thereon.

8. A joining means for removable rotor discs located away from potential fatigue points in said discs wherein at least a pair of spaced joinable discs are positioned to rotate about a common axis, said joining means comprising:

a) a spacer arm extending between said discs in contact therewith, said spacer arm contacting a piloted joint in one of said discs under axial compression, b) each disc having a flange spaced from the spacer arm, which flange extends between said discs toward the flange of said other disc and c) securing means to removably join said flanges under axial tension in a pre-loaded redundant support junction to thus remotely join said discs.

9. The joining means of claim 8 wherein said flanges thus joined, define a cylinder, which cylinder has a plurality of vent apertures therein.

10. The joining means of claim 9 wherein said spacer arm slants between said discs and relative to the so joined flanges and defines with said flanges, an annular cavity between said discs.

11. The joining means of claim 8 joining said discs which each are already joined to one or more other discs.

12. The joining means of claim 8 wherein said securing means are bolts or studs through bolt holes.

13. The joining means of claim 8 wherein said discs have rotor blades mounted thereon.

14. The joining means of claim 8 wherein said flanges have scalloped edges.

* * * * *